US006662905B2

(12) United States Patent
Sors

(10) Patent No.: US 6,662,905 B2
(45) Date of Patent: Dec. 16, 2003

(54) ELEVATOR WHICH COUNTERWEIGHT IS ALSO THE PLUNGER OF THE PROPELLING FLUID DYNAMIC DEVICE WHICH PRODUCES AND CONTROLS THE MOVEMENTS THEREOF

(76) Inventor: Carlos Alberto Sors, Avenida Pedro Zanni 1507-Paraná, Pcia. de Entre Rios (AR)

( * ) Notice: Subject to any disclaimer, the term of this patent is extended or adjusted under 35 U.S.C. 154(b) by 6 days.

(21) Appl. No.: 09/847,282

(22) Filed: May 3, 2001

(65) Prior Publication Data

US 2002/0029938 A1 Mar. 14, 2002

(30) Foreign Application Priority Data

May 19, 2000 (AR) ..... 102412
Mar. 7, 2001 (AR) ..... 10101063

(51) Int. Cl.[7] ..... B66B 9/04; B66B 17/12

(52) U.S. Cl. ..... 187/347; 187/253; 187/272; 187/275; 187/345; 187/404; 254/386

(58) Field of Search ..... 187/250, 251, 187/252, 253, 254, 272, 345, 404, 405, 413, 274, 275; 60/473, 474, 476; 254/385, 386

(56) References Cited

U.S. PATENT DOCUMENTS

| | | | | | |
|---|---|---|---|---|---|
| 269,994 | A | * | 1/1883 | Bailey | 254/386 |
| 298,292 | A | * | 5/1884 | Curtis | 187/379 |
| 307,998 | A | * | 11/1884 | Smith | 187/253 |
| 392,753 | A | * | 11/1888 | Read, Jr. et al. | 187/347 |
| 407,200 | A | * | 7/1889 | Guthrie | 187/273 |
| 494,217 | A | * | 3/1893 | Miles | 187/251 |
| 815,401 | A | * | 3/1906 | Breckon | 187/251 |
| 887,154 | A | * | 5/1908 | Vleck | 187/347 |
| 965,542 | A | * | 7/1910 | Schuller | 187/275 |
| 2,222,685 | A | * | 11/1940 | Raymond | 187/409 |
| 2,417,947 | A | * | 3/1947 | Reedy | 60/474 |
| 2,906,374 | A | * | 9/1959 | Brumby | 187/251 |
| 4,488,621 | A | * | 12/1984 | Schiewe | 187/347 |
| 4,548,296 | A | * | 10/1985 | Hasegawa | 187/275 |
| 4,703,835 | A | * | 11/1987 | Negrutsky et al. | 254/389 |
| H702 | H | * | 11/1989 | Shively et al. | 187/405 |
| 5,566,786 | A | * | 10/1996 | De Angelis et al. | 187/266 |
| 5,957,779 | A | * | 9/1999 | Larson | 472/34 |
| 5,975,246 | A | * | 11/1999 | Toschi | 187/275 |

FOREIGN PATENT DOCUMENTS

| | | |
|---|---|---|
| DE | 957060 | * 11/1999 |
| JP | 10279233 | * 10/1998 |

* cited by examiner

*Primary Examiner*—Eileen D. Lillis
*Assistant Examiner*—Paul T. Chin
(74) *Attorney, Agent, or Firm*—Venable LLP; John P. Shannon; Chad C. Anderson

(57) ABSTRACT

An elevator includes a special propelling fluid dynamic device which uses as a plunger the duly balanced car counterweight. The car conveys people and things upwards and downwards within a vertical conduit or hoistway supported by a cable extending to an upper pulley. When changing the direction, a counterweight is extended to balance the car. The pulley is supported from the hoistway walls and is kept in a freely-rotating condition while the balanced counterweight is a hollow piston-counterweight, accommodated in the cylinder vertically disposed in the hoistway itself and adjacent to the car. Both are integral with the propelling fluid dynamic device that produces the upward and downward movements of the car, which is completed with a circuit having a fluid flow conduit and a driving pump coupled to the valve mechanism.

15 Claims, 10 Drawing Sheets

ELEVATOR WHICH COUNTERWEIGHT IS ALSO THE PLUNGER OF THE PROPELLING FLUID DYNAMIC DEVICE WHICH PRODUCES AND CONTROLS THE MOVEMENTS THEREOF

BACKGROUND OF THE INVENTION

This invention relates to an ELEVATOR WHICH COUNTERWEIGHT IS ALSO THE PLUNGER OF THE PROPELLING FLUID DYNAMIC DEVICE WHICH PRODUCES AND CONTROLS THE MOVEMENTS THEREOF, that brings several advantages over the other vertical translation devices known so far.

More specifically, this invention relates to an elevator lifter for vertically carrying people or things, of the type having a car which moves between vertical guides, arranged within a conduit called "hoistway", said car being supported on a cable extending to a pulley or wheel that is part of the elevator, wherefrom it projects for extending to a counterweight means which is cooperative with said elevator.

In very well known embodiments, said pulley is powered by an electrical engine which operates the cable extending between the car and the counterweight.

The usual, universally known purpose of the "counterweight" is to reduce the power of the engine. In fact, generally the counterweight has a weight that is equal to that of the car increased in about 40 to 45% of the duty load; in this way the engine only has to lift the unbalanced part of the load and avoid any rubbing.

In this particular case, the invention relates to an elevator conceived with the novel feature of using the counterweight as a piston or plunger of a fluid dynamic device that propels said vertical movements to the car.

For the rest of the constructive aspects, the inventive elevator, as regards its car and assembly (guides, parachutes, and the like), is of a conventional type. It is a rule-conforming, "standard" elevator.

Consequently, this is an embodiment that from the beginning avoids the need of installing a lifting machine that may be arranged either above or below the hoistway for commanding the movement of said wheel that drives and powers the cable. Instead, a single freely rotating pulley is disposed, the function of which is to guide the cable to the equilibrated counterweight which, as indicated by the title of the invention, is the plunger of the propelling fluid dynamic device.

PRIOR ART

Several constructive and functional embodiments of elevators are known. Among these embodiments, the most traditional one is that in which cables guided and powered from a generally electrical engine are used for the vertical movement of the car. There also exist some others that usually use vertical racks wherein the operating teeth are engaged, the teeth being powered by an engine accommodated in the car itself.

Among the elevators that use propelling fluid dynamic devices are both, hydraulic lifts and pneumatic lifts. Hydraulic lifts known at present have similar features located to that of electrical lifts. The car also moves being guided by vertical steel profiles placed in the hoistway and have the characteristic of including a cylinder inside which a piston for raising the car moves. A tight pipe extends from the cylinder bottom to the liquid reservoir; the liquid reservoir is generally placed in the machine room, where also the hydraulic pump is accommodated with its corresponding engine and directional valves. The pump pressure injects liquid in the bottom of the cylinder, so the plunger is pushed upwards, thus raising the car. When the fluid supply is interrupted, the car stops. Downward movement starts from an electrical order, which produces the opening of the valves so as to allow for the liquid to go back to the reservoir. The weight of the plunger, the car, the load and the fluid itself, generate a pressure sufficient for the liquid to outflow. As fluid pressure varies according to the load being carried, downward movement speed also varies as a function of the load.

The advantage of this type of lifters is that no large installations above the hoistway are required, so it is fully used for movements of the car.

A generalized drawback is that the length of the cylinder should be slightly longer that the car path of motion, which creates the need for large installations out of the hoistway, generally below the hoistway. It is for this reason that they have a limited distance to travel (two or three stops). They are devices that operate under great pressure, so their installations are highly expensive, not only due to their size, but also for the constructive precision of the hydraulic parts necessary for them.

In this sense, those, which use side pistons, are preferred, as their stroke is half the path of motion of the car; nevertheless the pulley systems that are used led to duplication of efforts with a lot of rubbing.

In fact, the hydraulic elevators known at present, the cylinders and pistons are rectified and require good seals or detents to support pressures higher than 5 kg/cm$^2$, i.e. 5 atmospheres or higher.

Among disclosures prior to this application U.S. Pat. No. 3,318,418 to William C. Kilpatrick can be mentioned, wherein it is taught an installation for a pneumatic elevator of the type where the car vertically moves as a piston within a tube (that forms the hoistway of the lift), in response to the pneumatic pressure existing in said tube, below the car.

U.S. Pat. No. 2,927,661 to Kristek et. al. teaches a lifter for people or loads that also uses a tight closing tube wherein a car moves. Said tube is part of a very particular pneumatic circuit where air is pressure-flown so as to produce the raising of the car. French patent number 71.02437 to Saunier Duval discloses a car which is the piston of a vertical pneumatic cylinder that moves upwards, by effect of an overpressure applied below the car, while it moves downward when a depressurization inside the tube and over the car is caused.

The applicant of the present invention is also the creator of a depressurization pneumatic elevator which was the subject matter of the Argentinean patent 245673 which fits a special construction through which the car raises or moves downward as a function of the depressurizations created between the ceiling of the car and the upper part of the tube over which it moves.

There are no previous disclosures regarding the use of the counterweight itself as a propelling means for moving the car upward and downward. In all cases they are used with the purpose of balancing the load, in an attempt that the effort made by the propelling means be the lowest possible. In this regard, mention is made to EP 0 957 060 to Klitzke Dieter where a conventional hydraulic elevator having the counterweight disposed external to the propelling cylinder is disclosed.

U.S. Pat. No. 5,901,814 to Leandre Adifon et. al. teaches an hydraulic elevator having a counterweight. In this case, the car is associated to the piston of a hydraulic cylinder, which is the propelling means for upward and downward movements thereof. In this case, the counterweight acts as such. It has the function of reducing the effort of the cylinder for movements. It has the same function as the balanced counterweights used in most elevators.

U.S. Pat. No. 5,957,779 to Walter F. Larson refers to a tower with a couple of gondolas hanging therefrom which, by their free ends, are attached to the piston of a hydraulic cylinder. Single counterweights are included for each gondola hanging from the same piston as a resource for balancing the load. Counterweights are not used as a propelling resource, either.

U.S. Pat. No. 5,975,246 to Renzo Toschi teaches a hydraulically balanced elevator. The patent discloses an elevator combining the use of a first cylinder and a second cylinder which are integral with a single hydraulic circuit which regulates the balance of the load in the car. Counterweights are included on the second cylinder. Neither in this case counterweights are used as movement propelling.

U.S. Pat. No. 5,238,087 to Alfonso Garrido et. al. relates to improvements tending to achieve energy savings for hydraulic elevators. In this case an hydraulic means is disclosed, the means is attached to the counterweight means so as to bear the weight of the car plus a 50$ of the duty load. It is a counterweight associated to a hydraulic resource, but nonetheless the use of the counterweight as a propelling means is not disclosed.

There exist, in fact, damping resources for downward movement, where the counterweight is integral with specific hydraulic circuits.

U.S. Pat. No. 4,488,621 to Herbert L. Schiewe relates to an emergency elevator. It is a cage coupled to a damping cylinder, which is integral with a valve-controlled circuit. No propelling counterweights are taught. The cylinder is disposed laterally to the cage and the damping piston has a weight slightly higher than the cage, even when it is used for raising the cage when it is empty (free from load).

It is a device specially designed for bringing people downwards in case of emergency, where downward movement of the cage is restrained by the piston.

NOVELTY OF THE INVENTION—MAIN OBJECT

There are no previous disclosures regarding the use of the counterweight itself as a propelling means.

In fact, elevators of the conventional type, which are powered by electric engines, the balanced counterweight alleviates the effort required by the engine for the upward and downward movement of the car.

For fluid dynamic elevators (both, hydraulic and pneumatic), constructions where the car is the operating means, either as a piston of the actuator or associated to a plunger or piston that supports and translates said car are used.

In no case, disclosures exist in that the counterweight is used as the piston of a propelling fluid dynamic device. This operating principle brings several advantages, not only constructive, but also related to installation and maintenance, since similar or even better results are achieved with lower effort.

From the operating principle above stated, it is possible to construct hydraulic and pneumatic installations that makes the plunger to move, which are dimensioned related to the counterweight that they move, so they turn out to be simpler and cheaper than fluid dynamic installations known so for actuating the car.

From the above operating principle, it is much simpler the assembly of the car inside the hoistway where it moves, as the presence of the machine associated to the electric engine is avoided, which is usually disposed in the upper part. In this case, it is replaced by a single pulley where the cable is deviated to the counterweight, the function of which will be only to allow for the change of direction in the vertical movements for raising and moving downward.

Note that for the case of the elevator of this invention, it is not necessary for the traditional machine room to be built in the upper part of the hoistway, so it can be fully used for the car movements.

Comparing this invention to the prior hydraulic elevators above, the invention results to be advantageous as regards installation since it is not necessary to place cylinders below the hoistway of the elevator or in a position lateral to the hoistway which require special installations with multiple pulleys.

Likewise, when comparing this embodiment to other pneumatic elevators, where the car is usually used as part of the fluid dynamic installation which causes the propulsion thereof, mention is made to the fact that in this case it is not necessary to have special conduits or pipes for the car movement, since neither tightness nor insulation in the interior of the car is required.

It is specially noted that, under the foregoing operation principle, for achieving the same or even better results, no specially dimensioned means are required, it is not necessary to submit the means to any special treatment (rectification, etc), and no special, expensive materials are used.

In fact, to achieve movement of counterweights by means of a pneumatic or hydraulic installation it is possible to use conventional cylinders (which do not need to be oversized), for pressures to which they are submitted are not high. So, it is unnecessary to perform special rectification works in the rubbing surfaces so as to correct fabrication defects, since the seals may easily absorb them. In the preferred embodiments pressures lower than atmospheric pressure shall be used.

In the preferred embodiments, the cylinders shall be placed within the hoist itself, where the car displaces, since its plan area may be up to ten times smaller than the plan surface of the car, while the length of the height shall be equivalent to the length of the path of motion of the car added to the stroke of the piston-counterweight.

The inventive elevator may use a counterweight-piston which weight is slightly lighter than the weight of the car, is the same as the weight of the car, or is heavier than the weight of the car. Should the weight be lighter than the weight of the car, power shall be consumed only for raising the elevator, as downward movement shall be regulated by means of valves, which are also of the conventional type and known per se.

After the explanation above, it can be seen that the main object of the invention is an ELEVATOR WHICH COUNTERWEIGHT IS ALSO THE PLUNGER OF THE PROPELLING FLUID DYNAMIC DEVICE WHICH PRODUCES AND CONTROLS THE MOVEMENTS THEREOF, of the type comprising a car for conveying people or things which moves between vertical guides disposed in a vertical conduit called hoistway, which is supported by a cable extending to an upper pulley and, changing the direction, extends to a counterweight balanced with said car; one of the main characteristics of the assembly is that said pulley is supported from the hoistway walls and is kept in a freely-rotating condition, while the balanced counterweight is a hollow piston-counterweight, located in a cylinder vertically disposed in the hoistway itself, adjacent to the car, both being integral with a propelling fluid dynamic device which produces upward and downward movements of the car, which is completed with a fluid circulation circuit, which comprises at least a driving pump coupled to valve means.

The invention provides for the cylinder to have a length slightly longer than the vertical path of motion that the car has to travel between the lower and the upper stops. The invention provides for the propelling device to be pneumatic, which driving pump is a rotary compressor coupled to solenoid valves.

The propelling device may be also hydraulic, which driving pump is a volumetric hydraulic pump, or a centrifugal pump, coupled to solenoid valves.

It is an option of the construction of this invention that the vertically disposed cylinder have the upper and lower bases thereof closed, and defining inside thereof two variable volume chambers, spaced apart by the piston-counterweight, both chambers are individually connected to a respective conduit for the fluid flow, extending to the driving pump of the propelling device.

It is also provided a vertically disposed cylinder, having an open upper basis and defining a variable volume chamber delimited by the piston-counterweight, while the lower basis is closed; the chamber is connected by conduits for inflow and outflow of the fluid, extending to the driving pump coupled to the valve means of the propelling device and the fluid reservoir or tank.

Also, it can be clearly seen that the fluid flow may be a pneumatic circuit comprising at least a pneumatic pump coupled to valve means, including air intake devices matching the variable volume chambers.

It is also provided that the fluid flow circuit be a hydraulic circuit, comprising at least a hydraulic pump coupled to valve means interbedded in fluid flow conduits which are connected to said chambers.

For the case of a pneumatic circuit, the fluid flow circuit, comprising at least a driving pump coupled to valve means, is external to the cylinder body accommodating the piston-counterweight and connects with it through conduits.

The invention also features a fluid flow circuit, comprising at least a driving pump coupled to valve means, which may be a closed circuit disposed inside the cylinder accommodating the piston-counterweight.

It is also provided that the driving pump and associated valve means may be directly disposed inside the piston-counterweight, being integral with the conduits that communicate with the variable volume chambers that may be specified with said piston-counterweight and the cylinder walls, defining a closed circuit.

The invention also provides for the driving pump and associated valve means to be accommodated inside the piston-counterweight, being integral with the conduits connecting the variable volume chambers specified with said piston-counterweight and the cylinder walls, including the respective valves for atmosphere air intake matching each chamber.

On the other side, the invention provides for the piston-counterweight to be hollow and accommodating inside thereof removable ballast elements.

The cable extending between the car and the piston-counterweight may be a sheathed cable.

Finally it is also pointed out that pivotable anchor bolts are included as matching the ceiling of the car, said anchor bolts oscillate about a transversal axis, which free ends face their respective anchoring cavities, defined in the hoistway walls matching each stop level, which transversal movements (for locking and unlocking actions) are commanded from an electromechanical means being integral with the operating circuit of the elevator; while the oscillatory movements thereof produced during loading and unloading of the car actuate electronic sensors integral with the operating circuit of the propelling device (with the purpose of ordering the automatic balancing of the piston-counterweight).

BRIEF DESCRIPTION OF THE DRAWINGS

So as to fully disclose the advantages that have been briefly explained, to which the users and those skilled in the art may add may others, and so as to facilitate understanding of the constructive, fabrication and operating features of the inventive elevators, a preferred example of an embodiment shall be described below, which is schematically illustrated and not in scale, in the attached drawings. Note that it is a non-limiting, non-exclusive example of the scope of the present invention, while its actual purpose is to further explain and illustrate the basic conception of the invention.

Mention is made that throughout the different views similar reference letters and numbers correspond to the same or equivalent parts or constitutive elements of the assembly, according to the selected example for the present disclosure of the inventive elevator.

DETAILED DESCRIPTION OF THE PREFERRED EXAMPLE

Figure 1:
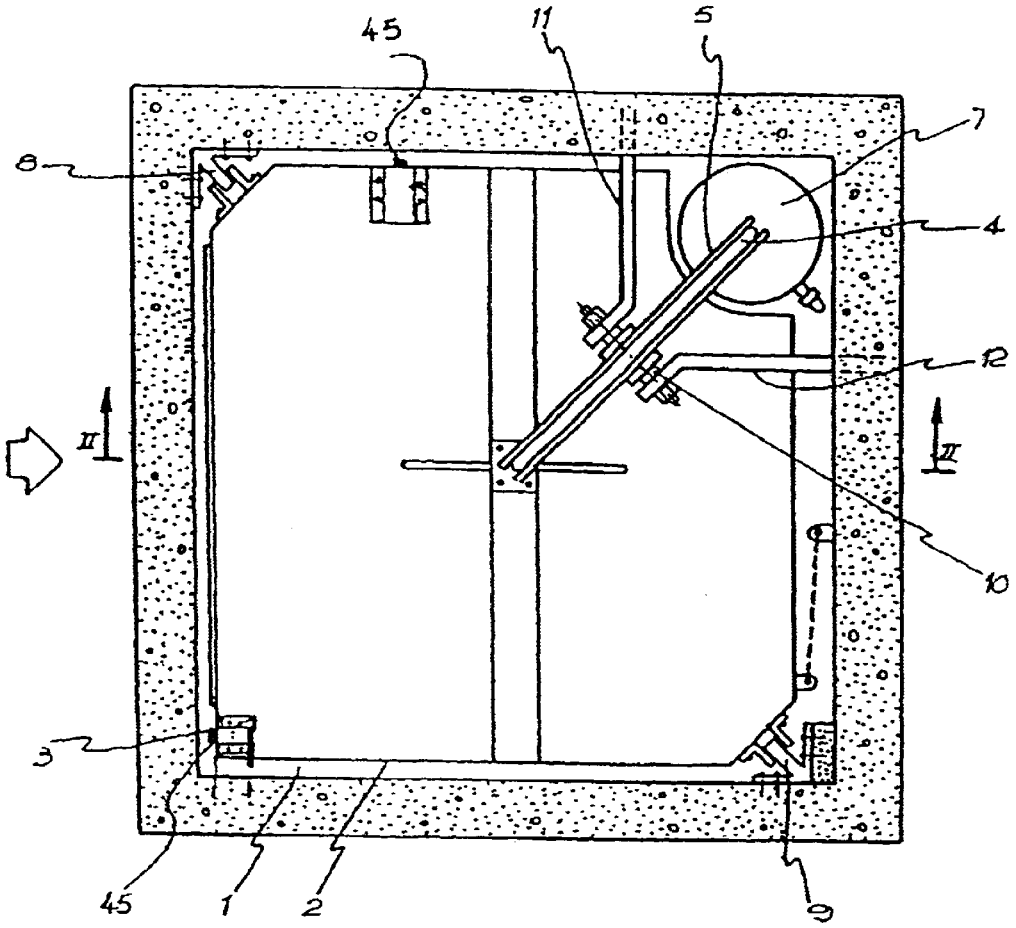
FIG. 1 is a plan top view deploying the hoistway of the elevator inside which a car is disposed, the car moves either hydraulically or pneumatically according to the present invention.

FIG. 1 shows the elevator which controlled, balanced counterweight is also the plunger of the propelling fluid dynamic device which produces and controls the movements thereof referred to in this invention, said elevator is suitable for installation in a conventional hoistway 1 which is generally square in shape, which makes the vertical conduit where the car 2 moves quite loosely, the car carries either people or things.

In this particular case, it can be seen that the car is attached to the cable 4 by the ceiling 3 of the car, the cable supporting the car and extending to engage the freely-rotating pulley 5, which deviates the cable and changes it vertical direction in 1800° so as to extend to the piston-counterweight 6 running as a plunger of the fluid dynamic cylinder 7, thus the conventional balance between the car-counterweight is established.

Figure 2:
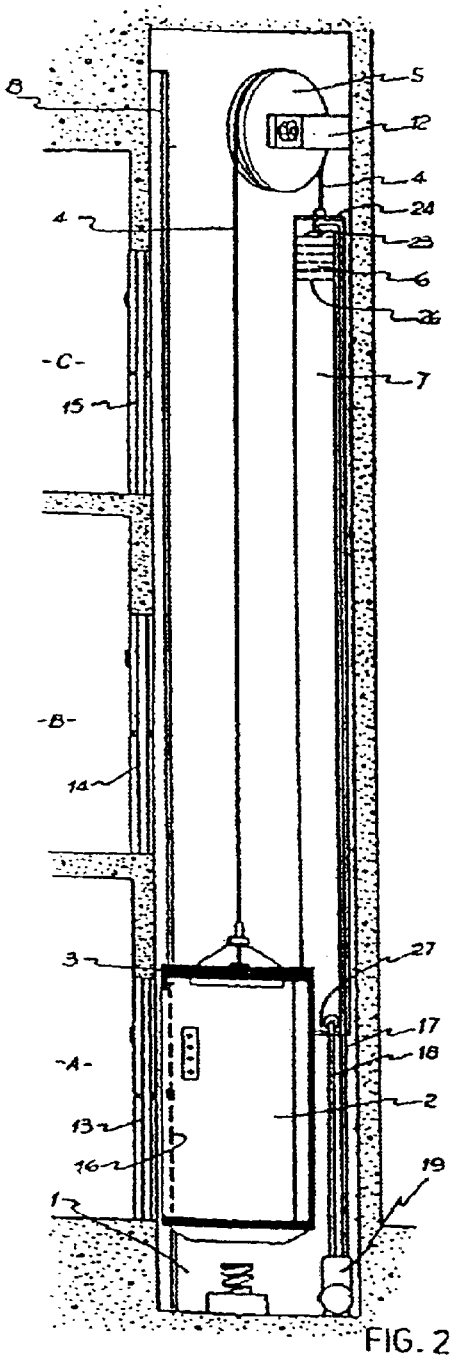
FIG. 2 is a schematic, longitudinal section view, according to the plan II—II of FIG. 1, representing three stop levels which connect with the hoistway of a fluid dynamic elevator inside thereof, which complies with the basic conditions set forth in this invention, where the car is placed as matching the first stop of lower stop.

As shown in FIG. 1, the car 2 displaces with upward and downward movements over the lateral guides 8 and 9 and is suitable balanced relative the piston-counterweight 6 (as can be seen in FIG. 2).

As already explained, said pulley 5 rotates freely and is placed in an upper end of the hoistway, mounted on an axis 10 which is supported from the walls thereof by arms 11 and 12. Also said cable 4 holds the car by a central point of the car ceiling 3.

Figure 3:
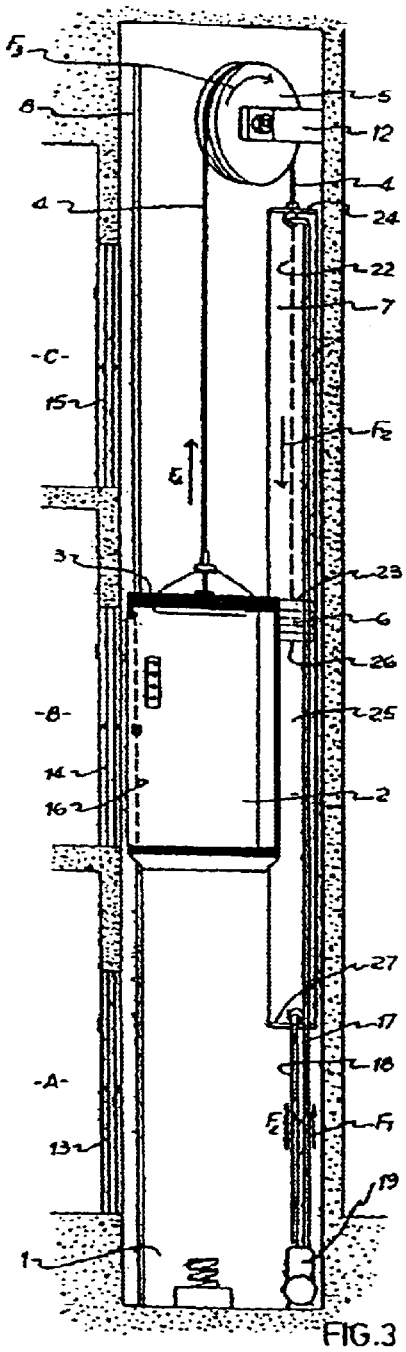
FIG. 3 is a longitudinal section of the plan II—II shown in FIG. 1, similar to that illustrated in the previous Figure, but in this case showing the car placed at the intermediate stop.

Going back to FIGS. 2 and 3, it is possible to fully understand the combination of means defined by the inventive elevator. In this case it can be seen that said elevator hoistway 1 has a height sufficient to comprise three stop levels A, B and C where the respective access doors 13, 14 and 15 appear, provided to face the doors 16 of the car 2, and so to allow entrance to and exit from the car.

Such as previously explained, the basic novelty of this embodiment is posed by the fact that said piston-counterweight 6 is said plunger of the fluid dynamic device formed for causing car 2 to lift.

It is referred to as fluid dynamic device since it can be either hydraulic or pneumatic, in which case only the valve resources and driving pumps vary, according to the particular type of fluid.

In these two Figures it can be seen that the piston-counterweight 6 acts inside the straight, vertical cylinder 7 preferably disposed as matching one of the four corners of the hoistway 1, and occupying only a minimal space, which is slightly longer than the vertical path of motion that the car 2 has to travel in order to move from the bottom level A to the upper level C, which is coincident with the stroke of the piston-counterweight 6 during its maximum upward or downward movements.

As can be seen in the Figures, a bottom free space is left for entering into the hoistway and performing any repairing or maintenance works that may be necessary.

Figure 4:
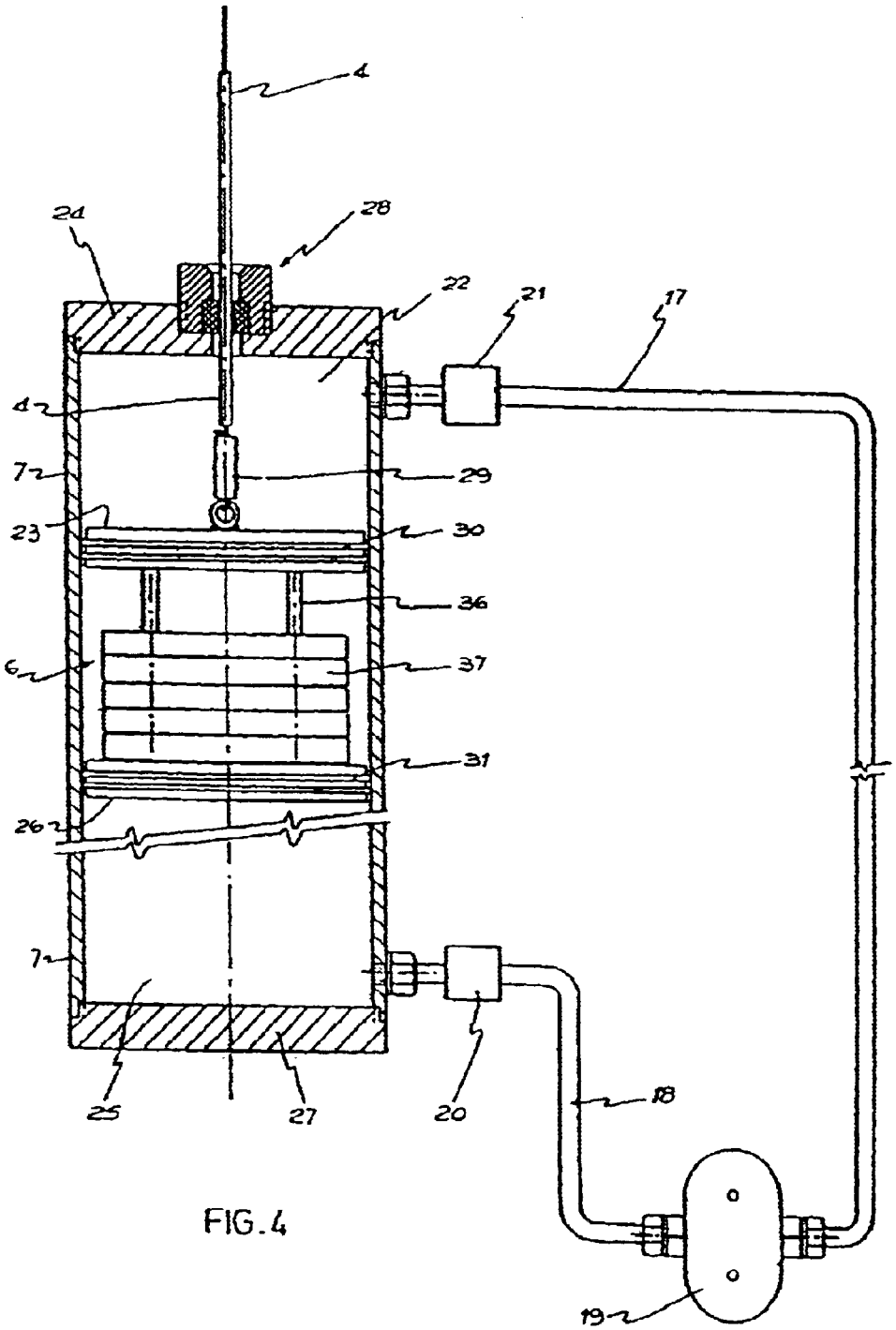
FIG. 4 is an enlarged detailed view showing the propelling device created for providing the vertical movements of the inventive elevator, wherein the fluid dynamic cylinder is shown in longitudinal section, while the rest of the fluid circuit is shown in a schematic view.

In the case shown in the first five Figures, said cylinder 7 is attached to the fluid flow conduits 17 and 18 extending form the pump 19 with the corresponding solenoid valves 20 and 21 being interbedded (as shown in FIG. 4).

In fact, if the example represented in the FIGS. 2, 3 and 4 is observed in detail, it can be seen that the cylindrical body 7 is closed. Consequently, a variable volume chamber is defined inside the body 22 delimited by the upper basis 23 of the piston-counterweight 6 and the upper basis 24 of the cylinder 7, as well as a lower variable volume chamber 25, delimited by the lower basis 26 of the piston-counterweight 6, and the lower basis 27 of said cylinder 7.

Seals 28, 30 and 31 are used for the normal operation of the system, both for the passage of said driving cable 4 (preferably sheathed) associated to the piston-counterweight 6 by roping 29, as well as for movement of the piston-counterweight 6.

When fluid is driven in the direction of the arrows F1 pressure is generated in said upper chamber 22 and depressurization is generated in said lower chamber 25, so the piston-counterweight 6 moves in the direction F2 exercising a traction force transmitted through the sheathed cable 4. Said traction makes the pulley 5 to rotate in direction F3 and thus to change the direction of traction transmitted to the car 2 which, as a consequence, is lifted in the direction F4.

In recent experiments a good performance is observed when volumetric pumps 19 are used, such as those identified as "Root type". In these cases correct operation was observed using a 100-kg car, with a maximum load of 200 kilograms, balanced with a piston-counterweight weighting 200 kilograms (as own weight), moving in a cylinder of 20 cm in diameter, so the areas of the upper basis 22 and the lower basis 23 are of 628 $cm^2$.

In this case, lifting the car, either empty of bearing the maximum load, only a force of 100 kilograms was exerted (160 $gr/cm^2$, which is about ⅙ of the atmosphere pressure).

As previously stated, pump 19 preferably is a rotary pump having a positive movement, which transfers (by revolution) the necessary fluid. They feature the advantage that when revolutions are electronically regulated, very effective speed variations are achieved, also starting and stopping are smooth. They work with an almost even flow rate for the case of the pneumatic ones and even in the case of those of the hydraulic type. They do not need any inverter valve as when the direction of rotation is modified, upward and downward movements of the piston-counterweight 6 are obtained. They are volumetric pumps or rotary compressors having a very good performance.

In this case, said pumps 20 and 21 are solenoid valves integral with the electronic command circuit of pump 19.

In the case of a pneumatic propeller, a rotary compressor 19 ("Root" type) shall be used, which operation is equivalent to that of the hydraulic pump. Using a pump which flow rate is 100 liters/second, with air inflow and outflow at atmospheric pressure, operating at 100 $gr/cm^2$, which is about 10% of the atmospheric pressure, both in pressurization and in depressurization conditions, the outgoing flow rate is about 90 liters/second.

Figure 5:
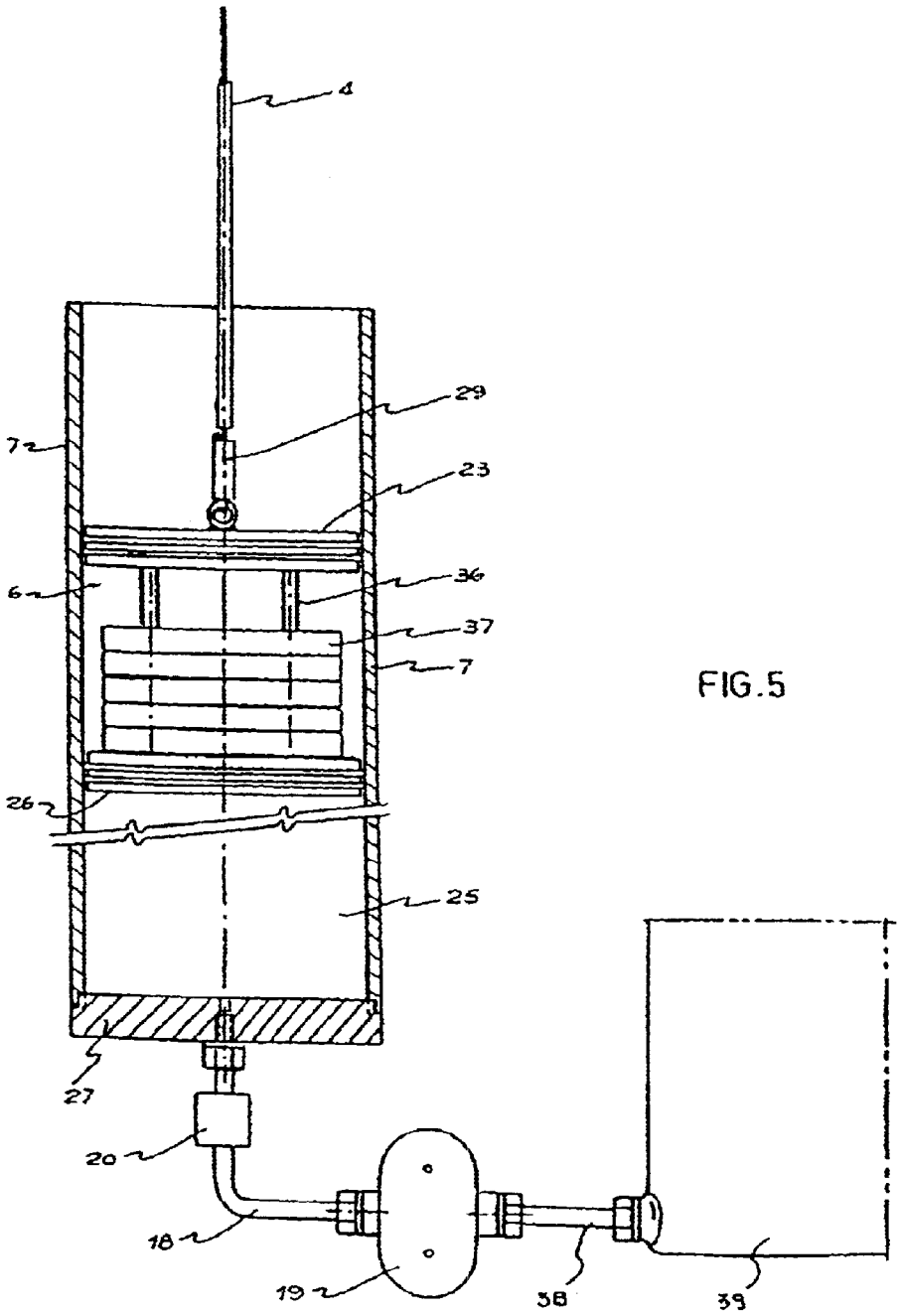
FIG. 5 is also an enlarged detailed view of the propelling device wherein a constructive, functional variable can be seen, through which the same operative result is obtained.

A constructive variable that also allows for implementing the same principle of operation referred to in this invention, is the variable represented in FIG. 5. In this case, said cylinder 7 is top-opened, so fluid dynamic pressurization and depressurization are produced in the lower chamber 25. Consequently, maximum depressurization shall be slightly lower than the atmospheric pressure acting over the upper basis 23 of the piston-counterweight. In this case, said volumetric close-coupled pump 19 is associated to a reservoir that receives the fluid 39 through a conduit 38.

Figure 6:
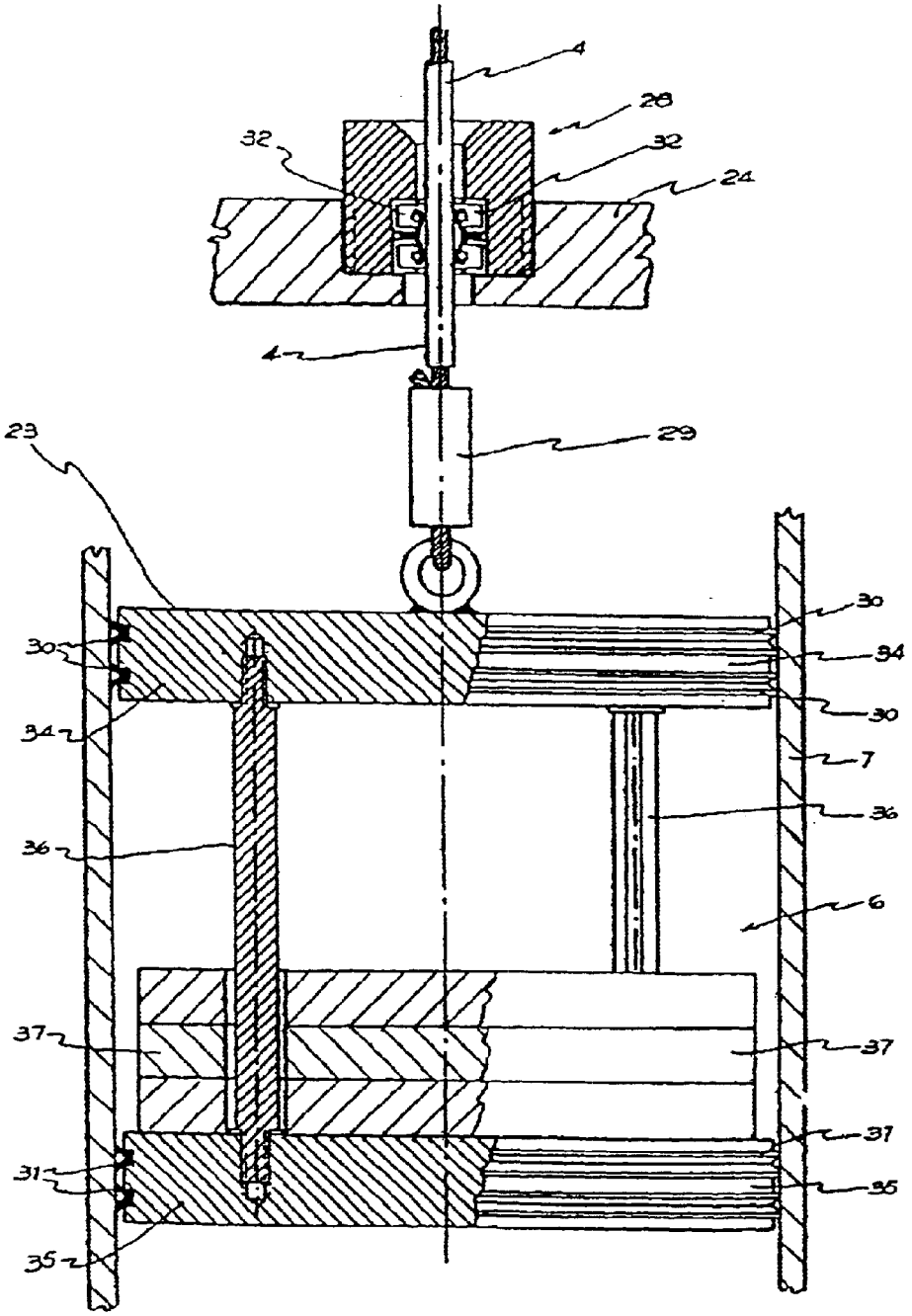
FIG. 6 is an enlarged detailed view showing a longitudinal section of the seal defined to allow for the driving cable to pass, the cable supports the elevator car and also the seals used by the counterweight-piston belonging to the propelling device of the present invention.

Obviously, said constructive solution, represented in this FIG. 5, presents the advantage that the sealing results simpler since the seals 28 for cable passage are avoided; nevertheless without sheath, the active surface of the piston-counterweight is reduced to a half. Experiments have been carried out using a 100 kilogram car 2 (own weight), and 200 kilograms of maximum load, and in this case, a piston-counterweight 6 of 200 kilograms (own weight) can be used, the piston-counterweight 6 moving in a cylinder 7 which diameter seizes 20 cm, so the area of active basis 26 of the piston-counterweight is of 314 $cm^2$. In this case, only a maximum additional force of 100 kilograms is necessary over the piston-counterweight weighting 100 kilograms, which represents about ⅓ of the atmospheric pressure. With reference to FIG. 6, it is possible to see in detail the seals required for normal operation of the propelling device.

For the case of seals 30 and 31 disposed as matching the piston-counterweight 6, the seals may comprise elastomer rings or rings made of any other similar material, suitable to operate in both movement directions thereof.

For the case of seal 28, elastic retainers 32 accommodated in a screwed support 33 that allows for its removal in case of replacement or repairing works are used.

In said FIG. 6 a constructive embodiment is also shown, which is functionally suitable for the piston-counterweight 6. In this case, it is a cylindrical, hollow body specified by disciform plates 34 and 35, associated to each other by means of double-ended bolts 36, so a free space is left for removably positioning the ballast 37.

Figure 7:
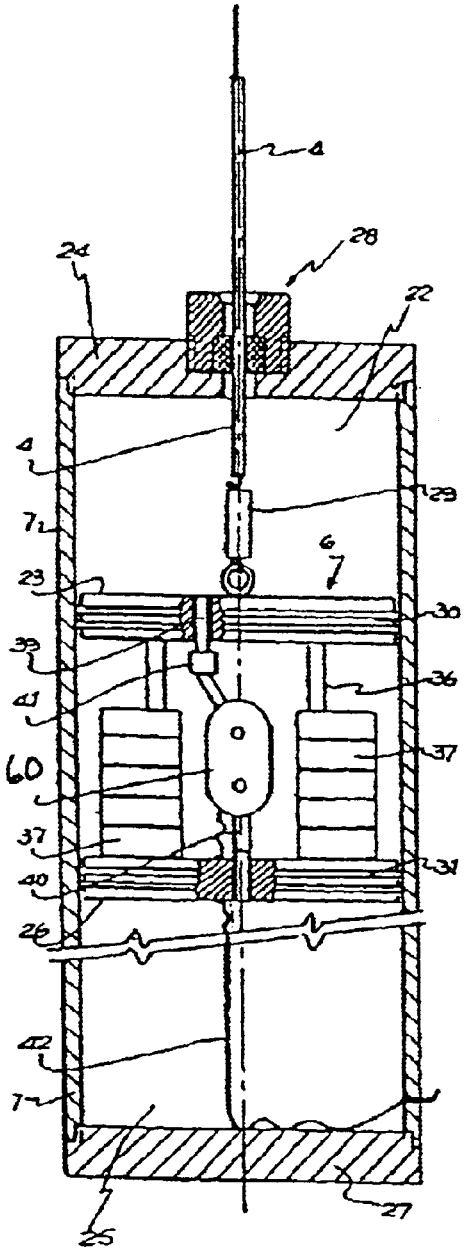
FIG. 7 is also a detailed view of the inner part of the propelling device, representing the case where the assembly is installed inside the body of the counterweight-piston.

In FIG. 7, a constructive option is shown, which falls within the scope of this invention, where the propelling device is defined as an internal closed circuit, essentially accommodated inside the piston-counterweight 6, where, pneumatic pump 60 associated to at least one solenoid valve 41 connects with said variable volume chambers 22 and 25 through conduits 39 and 40. It is by means of the conductor 42 that both, the pump 60 and said valve 41, will be associated to the electrical operating control of the propelling device.

Figure 8:
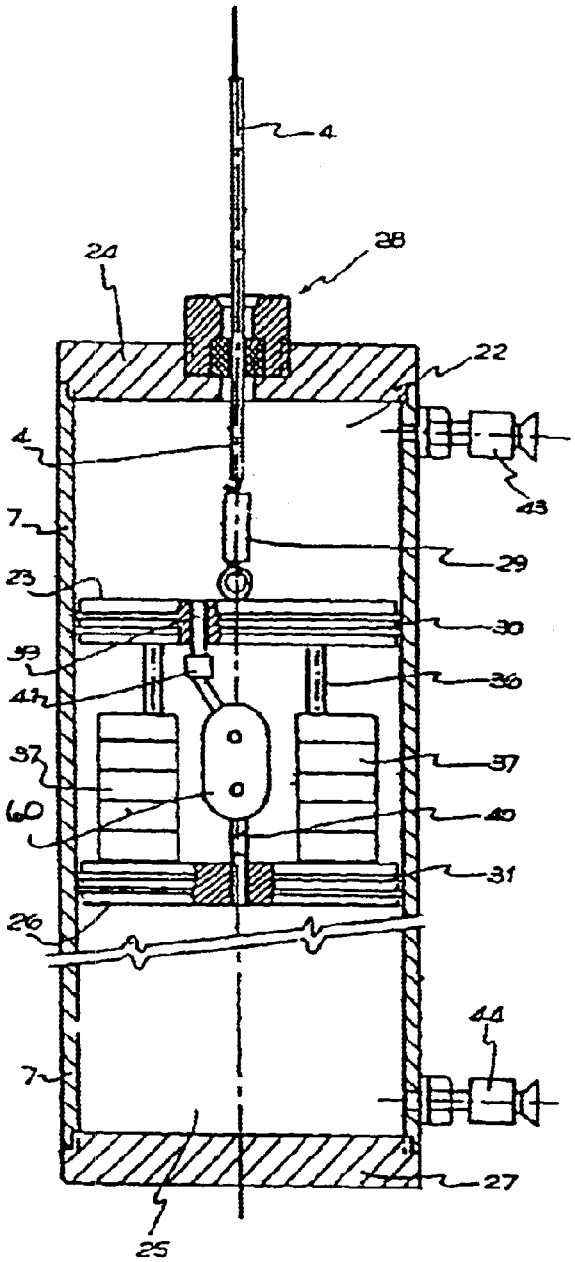
FIG. 8 is also a detailed view of the inside part of the propelling device, similar to that of the previous Figure, representing the case wherein the assembly is installed inside the body of the counterweight-piston, and the variable volume chambers which are defined include atmosphere air intake devices.

In this case, when the pump 60 produces pressure in one of said chambers; a simultaneous pressure is created in the other, and thus the operative movements of the piston-counterweight 6 for the upward and downward movement of the car. The constructive solution deployed in. FIG. 8 is also within the scope of the present invention. This solution also features a propeller defined inside cylinder 7, in this case the piston-counterweight may have a, weight slightly lighter than the car, since valves 43 and 44 are included, so as to allow for air inflow and outflow. In this case, pressure generation in a chamber, with simultaneous depressurization in the other, is produced by combining the operation of said pneumatic pump 60 (associated to at least one solenoid valve 41), with the opening and closing of said external valves 43 and 44.

Figure 9:
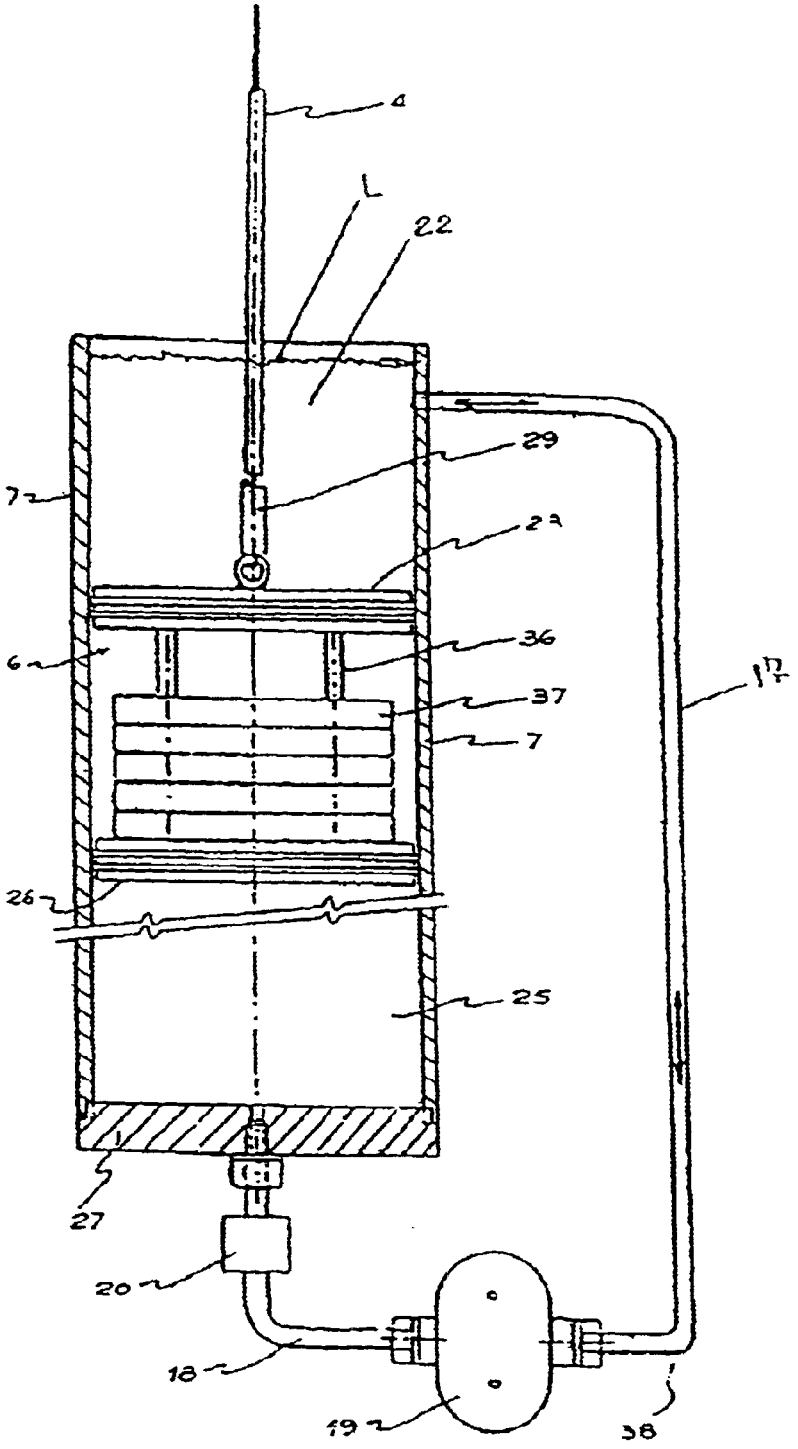
FIG. 9 is a detailed view of the inside part of the propelling device, similar to those of the previous Figures, but in this case a different constructive variation is shown, which is defined in order to reduce propelling efforts.

In FIG. 9 another variant falling within the scope of the invention is shown. In this case, the propelling piston-counterweight 6 is also accommodated inside the hydraulic cylinder 7 between both variable volume chambers 22 and 25, but a novelty is included in that both chambers keep a communication through the external conduit 17. The principle of "communicating vessels" is established, since, the liquid expelled from one of the chambers enters the other one. Thus, the force exerted for producing movements of the piston, for example, is lower than that of the case represented in FIG. 5 above.

In fact, in this variant the upper chamber 22 is opened and the liquid level -L- is above the connection 17 with the lower chamber 25. Therefore, irrespective of the height of the cylinder 7 the return keeps the same pressure. So, both have the same pressure of the liquid column (communicating vessels), which has no influence as extra pressure to overcome. The pump 19 will produce the pressure or depressurization necessary for balancing the counterweight.

Obviously, for multiplying the force, more than one propelling cylinder may be used. Even a single cylinder may be replaced by a plurality of smaller cylinders, which are easier to accommodate and distribute inside the hoistway.

Figure 10:
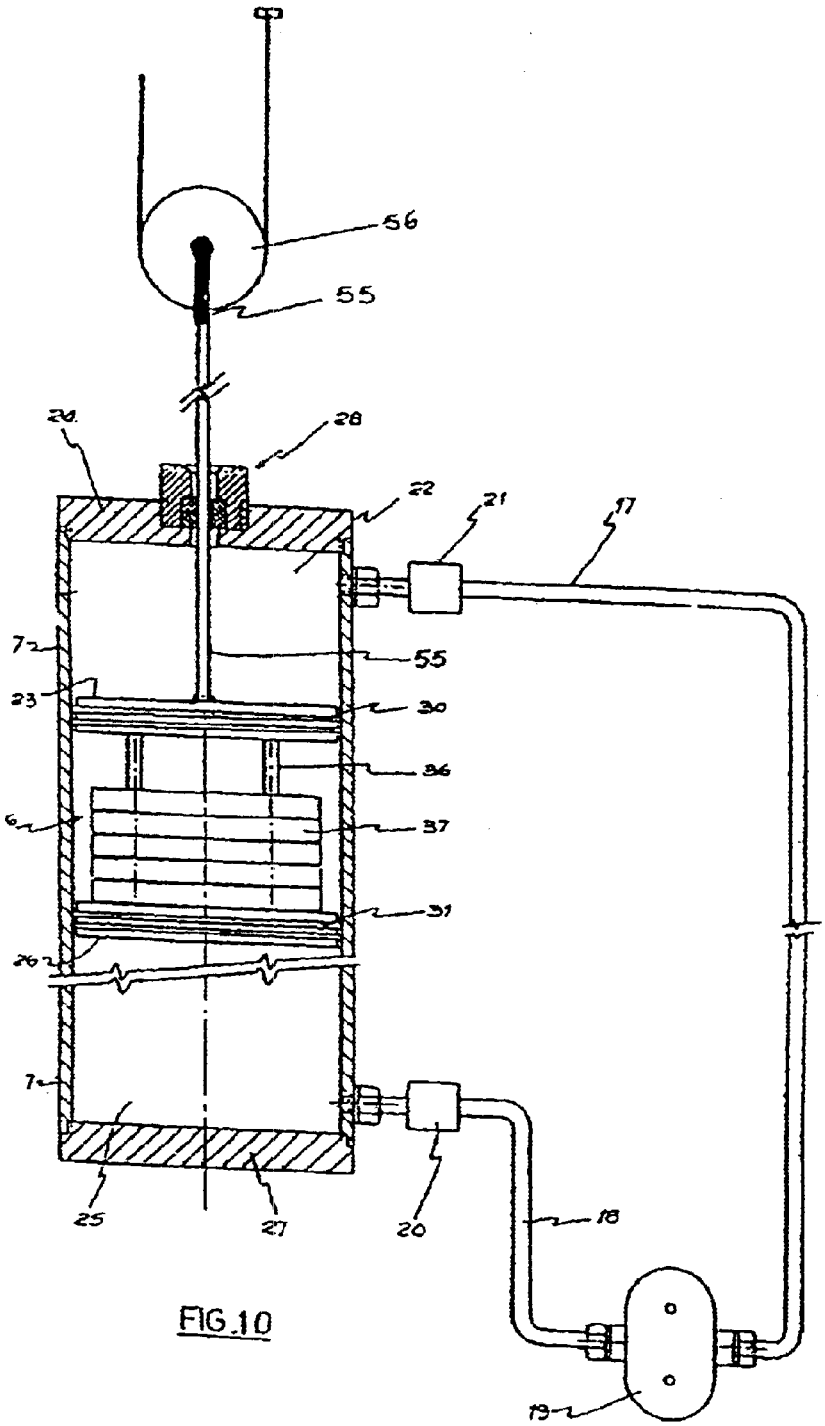
FIG. 10 is a detailed view of the propelling device, similar to those of the previous Figures, showing a further constructive variation provided by the invention.

The variant shown in FIG. 10 represents a case where the piston-counterweight 6 is associated to a stem 55 including a pulley 56 of a standard type. This solution turns out to be useful for hydraulic lifters, where the path of movement of the car needs to be multiplied due to constructive reasons.

Figure 11:
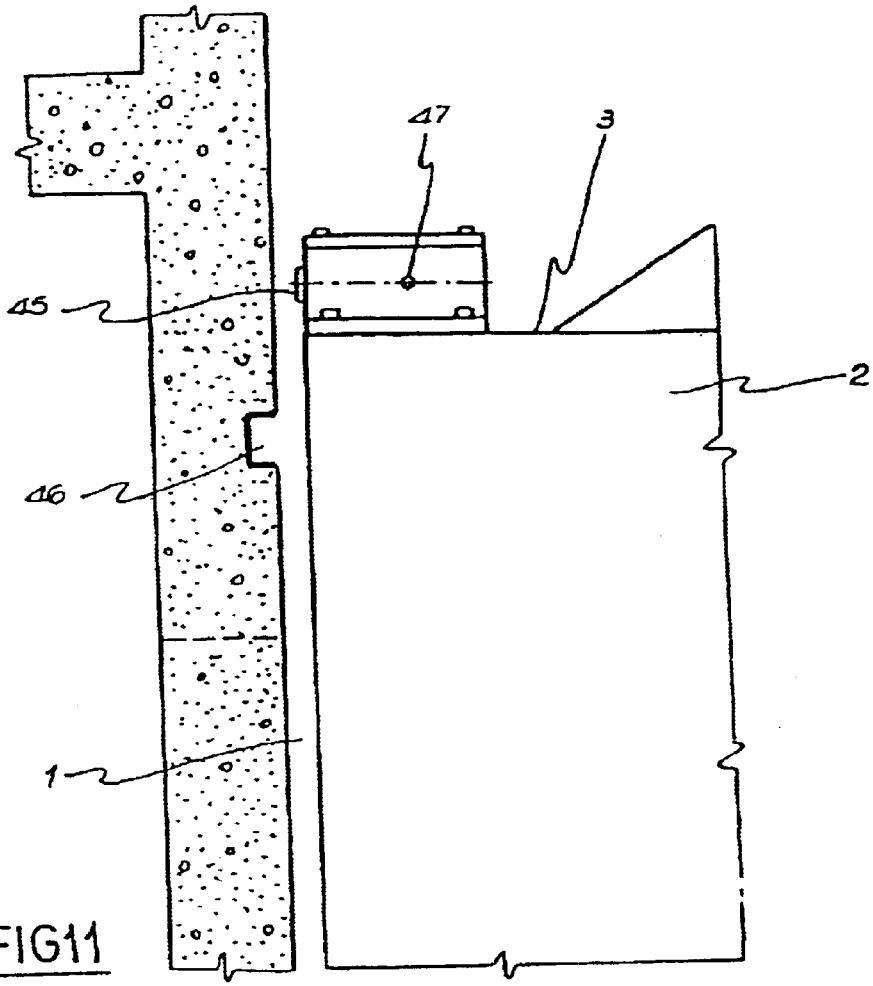
FIG. 11 is an enlarged detailed view showing the presence of locking devices defined in the car facing the anchoring cavities disposed in the hoistway of the elevator.
Figure 12:
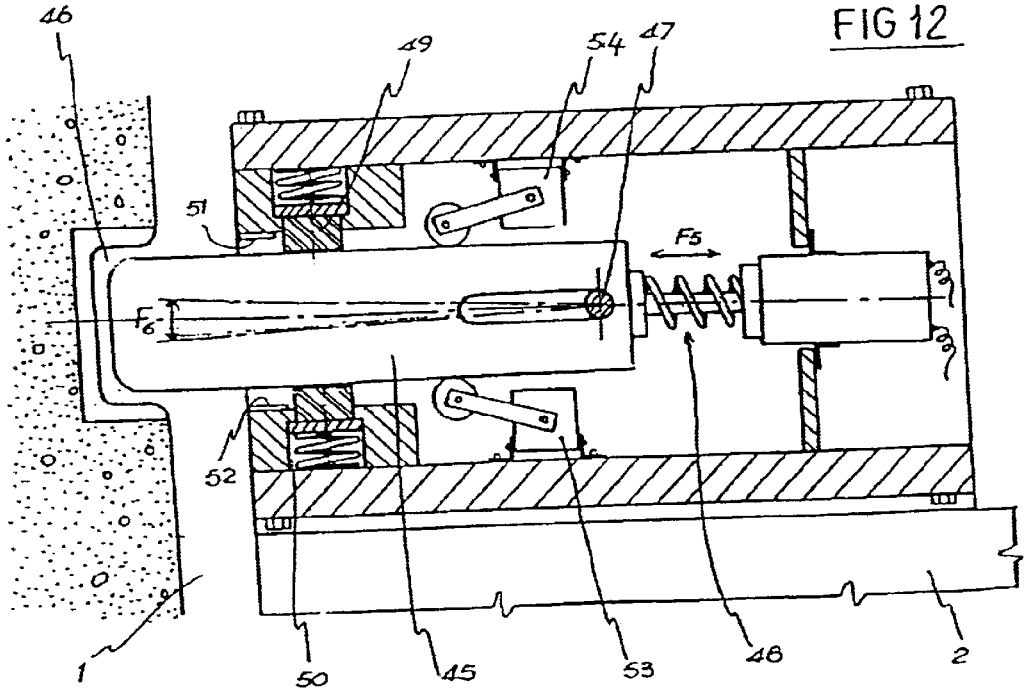
FIG. 12 is an enlarged detailed view through which the combination of basic elements used by the locking devices of the previous Figure is shown.

FIGS. 11 and 12 have been added for explaining that in this invention a supplementary safety resource may be included, which is integral with the command system of the propelling device for balancing of piston-counterweight when the people or things in the car 2 are moved upwards or downwards.

The resource also includes an array of anchoring bolts 45 (at least two bolts), which in the illustrated case are disposed as matching the ceiling of the car, the free ends thereof face respective receiving cavities 46 disposed on the wall of the hoistway 1 at height points as suitable for matching each stop.

As can be seen in detail in FIG. 12, each bolt 45 pivots about a transversal axis 47 which is also a stop that limits its outward projecting stroke to anchor the lock. Said stroke, represented by arrows F5 is produced by an electromechanical means, such as the electromagnet 48 that is integral with the commanding electrical circuit for producing the movement of the bolt when performing as anchoring in the stop and retracting it unlocked when the car 2 begins movement.

The novelty incorporated, as represented by arrows F6, is that each bolt has a certain clearance that allows for the oscillation about axis 47 Said angular movements are controlled by centralizes means 49 and 50 and limited by stops 51 and 52.

Precisely, said angular movements are specially provided for the operation of electronic sensors 53 and 54 (micro switch), which are integral to the command circuit of the propelling device aiming to indicate other oscillations, and thus producing the automatic balancing of the piston-counterweight 6, as a function of the newly acquired weight of the car.

It is finally stated that the invention also provides for said freely rotating pulleys 5 to include breaking resources, so safety in the stops is improved.

What is claimed is:

1. ELEVATOR which counterweight is also a plunger of a propelling fluid dynamic device which produces and controls the movements thereof of the type comprising a car for conveying either people or things that moves between vertical guides disposed inside a vertical conduit having walls, said car being supported on a cable extending to an upper pulley, and, changing direction, it projects to a counterweight balanced with said car, characterized in that said pulley is supported from the vertical conduit walls and is kept in a freely-rotating condition, while the balanced counterweight is a hollow piston-counterweight, accommodated in a cylinder vertically disposed in the vertical conduit itself, adjacent to the car, both forming part of the propelling fluid dynamic device which produces upward and downward movements of the car, which is completed with a fluid circulation circuit, which comprises at least a driving pump coupled to valve means, wherein the vertically disposed cylinder has upper and lower bases thereof closed, and which inner part defines two variable volume chambers, the chambers being spaced apart by the piston-counterweight, both chambers are individually connected to a respective conduit for the fluid flow, extending to the driving pump of the propelling device.

2. ELEVATOR as set forth in claim 1, characterized in that the cylinder is slightly longer than the vertical path of motion that the car has to travel between bottom and top stops.

3. ELEVATOR as set forth in claim 1, characterized in that the propelling device is pneumatic, which driving pump is a rotary compressor couple to solenoid valves.

4. ELEVATOR a set forth in claim 1, characterized in that the propelling device is hydraulic, which driving pump is a volumetric hydraulic pump coupled to solenoid valves.

5. ELEVATOR as set forth in claim 1, characterized in that the upper basis of the piston-counterweight is coupled to a rigid, longiform stem that extends projecting out of the cylinder, till it engages an movable pulley in which throat the cable supporting the car is accommodated.

6. ELEVATOR as set forth in claim 1, characterized in that the fluid flow circuit is a pneumatic circuit comprising, at least, a pneumatic pump coupled to valve means, including air intakes matching the variable volume chambers.

7. ELEVATOR as set forth in claim 1, characterized in that the fluid flow circuit is a hydraulic circuit, comprising at least a hydraulic pump coupled to valve means interbedded in fluid flow conduits which connect with said chambers.

8. ELEVATOR as set forth in claim 7, characterized in that the driving pump and the associated valve means are accommodated inside the piston-counterweight, which are integral with the conduits connecting the variable volume chamber.

9. ELEVATOR as set forth in claim 1, characterized in that the fluid flow circuit, comprising at least a driving pump coupled to valve means, is external to the cylinder body where the piston-counterweight is accommodated and is connected to it by means of conduits.

10. ELEVATOR as set forth in claim 9, characterized in that the driving pump and the associated valve means are accommodated inside the piston-counterweight, which are integral with the conduits connecting the variable volume chamber specified with said piston-counterweight and the cylinder walls, including respective atmosphere air intake valves disposed as matching each chamber.

11. ELEVATOR as set forth in claim 1, characterized in that the fluid flow circuit, comprising at least a driving pump coupled to valve means, is a closed circuit disposed inside the cylinder where the piston-counterweight is accommodated.

12. ELEVATOR as set forth in claim 1, characterized in that the piston-counterweight is hollow and removable ballast elements are accommodated therein.

13. ELEVATOR as set forth in claim 1, characterized in that the cable extending between the car and the piston-counterweight is a sheathed cable.

14. ELEVATOR as set forth in claim 1, characterized in that the upper pulley includes braking means, the command of which is integral with the control circuit in the different stop levels of the car.

15. ELEVATOR as set forth in claim 1, characterized in that that pivotable anchoring bolts are included as matching the ceiling of the car, said anchoring bolts oscillate about a transversal axis, which free ends face their respective anchoring cavities, defined in the vertical conduit walls as matching each stop level, which transversal movements for locking and unlocking actions are commanded from an electromechanical means being integral with the operating circuit of the elevator; while the oscillatory movements thereof produced during loading and unloading of the car actuate electronic sensors integral with the operating circuit of the propelling device with the purpose of ordering the automatic balance of the piston-counterweight.

* * * * *